US005730536A

United States Patent [19]

Yamaguchi

[11] Patent Number: 5,730,536

[45] Date of Patent: Mar. 24, 1998

[54] TAPE PRINTER HAVING PLATEN MOVING MECHANISM AND MECHANISM FOR INTERLOCKING PLATEN AND TAPE FEED ROLLER WITH MOVEMENT OF COVER

[75] Inventor: Koshiro Yamaguchi, Kasugai, Japan

[73] Assignee: Brother Kagyo Kabushiki Kaisha, Nagoya, Japan

[21] Appl. No.: 613,099

[22] Filed: Mar. 8, 1996

Related U.S. Application Data

[62] Division of Ser. No. 298,676, Aug. 31, 1994, Pat. No. 5,536,092.

[30] Foreign Application Priority Data

Sep. 6, 1993 [JP] Japan ..... 5-221426

[51] Int. Cl.[6] ..... B41J 15/04

[52] U.S. Cl. ..... 400/615.2; 400/586; 400/613

[58] Field of Search ..... 400/615.2, 586, 400/611, 613

[56] References Cited

U.S. PATENT DOCUMENTS

| | | | |
|---|---|---|---|
| 4,607,969 | 8/1986 | Collina . | |
| 4,653,939 | 3/1987 | Hibino | 400/219 |
| 4,730,780 | 3/1988 | Shimoyama . | |
| 4,797,690 | 1/1989 | Takita et al. . | |
| 4,806,033 | 2/1989 | Ukmar et al. . | |
| 4,966,476 | 10/1990 | Kuzaya et al. . | |
| 5,188,469 | 2/1993 | Nagao et al. . | |
| 5,193,926 | 3/1993 | Kuzuya et al. | 400/615.2 |
| 5,222,818 | 6/1993 | Akiyama et al. . | |
| 5,295,753 | 3/1994 | Godo et al. . | |
| 5,296,084 | 3/1994 | Hattori et al. | 400/613 |
| 5,374,132 | 12/1994 | Kimura | 400/586 |
| 5,399,030 | 3/1995 | Niwa et al. | 400/586 |

FOREIGN PATENT DOCUMENTS

| | | |
|---|---|---|
| 0-142-676 | 6/1987 | Japan . |
| 2-56666 | 4/1990 | Japan . |

*Primary Examiner*—John S. Hilten
*Attorney, Agent, or Firm*—Oliff & Berridge PLC

[57] ABSTRACT

A tape printer capable of performing multicolor printing and permitting an already printed tape to be rewound for printing two line character trains, bold printing and adding ornamental frames beside the first printed character train. The tape printer installs therein a tape cassette in which is housed a print tape and an ink ribbon formed with different colored ink portions at a set pitch in the lengthwise direction of the print tape. An ink ribbon take up mechanism is provided for taking up ink ribbon that passes between a platen and a print element provided external to the cassette. Tape transport mechanism is provided for transporting the print tape. The tape printer is constructed so that ink ribbon and the print tape are transportable in a forward direction for printing, and the ribbon take up mechanism stops and the platen is movable away from the printing section when the tape transport mechanism reversely transports the print tape.

21 Claims, 14 Drawing Sheets

TAPE PRINTER HAVING PLATEN MOVING MECHANISM AND MECHANISM FOR INTERLOCKING PLATEN AND TAPE FEED ROLLER WITH MOVEMENT OF COVER

This is a Division of application Ser. No. 08/298,676 filed Aug. 31, 1994 now U.S. Pat. No. 5,536,092.

BACKGROUND OF THE INVENTION

The present invention relates to a tape printer for printing images, such as characters and diagrams, on a print tape.

The tape printer generally includes a print element, which includes a thermal head, a platen, a tape transport means, and an ink ribbon take-up means. A cassette which houses therein the print tape, which is the medium to be printed on, and an ink ribbon, can be freely inserted into and removed from the tape printer.

A Japanese Utility Model Application Kokai No. HEI-2-56666 discloses a tape printer for printing labels and the like on a print tape, which is a medium to be printed on. The print tape is housed in a cassette along with an ink ribbon. The cassette can be freely inserted into and removed from the tape printer. The tape printer includes a print element such as a thermal head, a platen which is provided so as to come into contact with and separate from the thermal head, an ink ribbon take up means, and the like. The tape printer draws the print tape from the cassette at an appropriate speed while printing images such as characters and the like on the print tape based on data that was previously inputted to the tape printer.

However, there are problems with the above-described tape printer in that the tape printer can only transport print tape in the direction in which the print tape is drawn from the cassette. Therefore, after an image, formed from characters for example, is printed following the lengthwise direction of the print tape, the print tape can not be rewound a predetermined distance in order to further print ornamental accessories around the already printed image, or to reprint over the printed image to form boldface type, or to print another different color layer in the widthwise direction of the print tape to form a two-leveled image.

Also, the print unit and the device for cutting the end of printed tape are provided at positions spaced away from each other in the direction in which the print tape is transported. With the structure, after a printed print tape is cut, subsequent printing to the unprinted print tape can only be started at a position far from the cut end of the unprinted print tape. In other words, a wasteful margin is formed at both ends of print tapes and print tape is wastefully consumed.

Further, cassettes for use in conventional tape printers house only one color ink ribbon. Therefore, images, such as characters, with different colors can not be printed following the lengthwise direction of the print tape.

SUMMARY OF THE INVENTION

It is therefore, an object of the present invention to provide a tape printer capable of performing overlapping printing, and the like.

Another object of the present invention is to provide such improved tape printer having an interlocking mechanism that can automatically change the positional relationship between a drive mechanism and the print tape in response to mounting and removal operation to the tape cassette relative to the tape printer, the drive mechanism including a tape transport means, a platen with respect to the print element, and the tape cassette housing therein the print tape and an ink ribbon, to thereby allow quicker mounting and removal of the tape cassette and perform quicker printing operation.

Still another object of the present invention is to provide such tape printer capable of printing two or more colors on the print tape.

These and other objects of the present invention will be attained by providing a tape printer having a tape cassette receiving portion for installing a cassette therein, the tape cassette housing therein a print tape, a tape spool which winds thereon the printing tape, an ink ribbon, an ink ribbon take up spool for taking up the ink ribbon therearound and a tape feed roller, the tape printer including a frame, printing means provided on the frame for printing an image on the print tape through the ink ribbon, the printing means comprising a platen and a print element which are provided external to the tape cassette when it is installed in the tape cassette receiving portion, ribbon take up means provided on the frame for taking up the ink ribbon that passes between the platen and the print element in a forward direction, tape transport means provided on the frame for transporting the print tape in the forward direction and a reverse direction, means for preventing the ribbon take up spool from its reversal rotation to prevent the ink ribbon from being rewound over the ribbon take up spool when the tape transport means moves for reversely transporting the print tape, and means for moving the platen away from the printing element when the tape transport means moves for reversely transporting the print tape.

In another aspect of the invention, there is provided a tape printer having a tape cassette receiving portion for installing a cassette therein, the tape cassette housing therein a print tape, a tape spool which winds thereon the printing tape and a tape feed roller, the tape printer comprising a frame, printing means provided on the frame for printing an image on the print tape, the printing means comprising a platen and a print element which are provided external to the tape cassette when it is installed in the tape cassette receiving portion, tape transport means provided on the frame for transporting the print tape in the forward direction and a reverse direction, a cover pivotally supported to the frame for closing the tape cassette receiving portion, a press roller provided in pressure contact with the tape feed roller, and interlocking means for moving the platen and the press roller toward and away from the print element and the tape feed roller respectively in accordance with a closing movement and opening movement of the cover, respectively.

In still another aspect of the invention, there is provided a tape printer having a tape cassette receiving portion for installing a cassette therein, the tape cassette housing therein a print tape, a tape spool which winds thereon the printing tape and a tape feed roller, the tape printer comprising a frame, a print element supported on the frame for printing an image on the print tape, the print element having a printing surface, a platen movable toward and away from the print element, the platen having one axial end provided with a gear, means for directing the platen in parallel with the printing surface when the platen nips the print tape with respect to the printing surface of the print element.

In still another aspect of the invention, there is provided a tape printer having a tape cassette receiving portion for installing a cassette therein, the tape cassette housing therein a print tape, a tape spool which winds thereon the printing tape, a tape feed roller, an ink ribbon and an ink ribbon take up spool, the tape printer comprising a frame, a print element supported on the frame, a platen supported on the frame and movable toward and away from the print element, a press roller supported on the frame and movable toward and away from the tape feed roller when the tape cassette is installed in the cassette receiving portion, a reversible drive motor supported to the frame, a gear train engaged with the reversible drive motor for transmitting normal rotation of the reversible drive motor to the tape spool, the tape feed roller, the press roller, the platen and the ink ribbon take up spool, and for transmitting reversal rotation of the reversible drive motor to the tape feed roller and the press roller, a reverse gear connectable to the tape spool, means for disconnecting the gear train to the ink ribbon take up spool when the reversible drive motor rotates in a reverse direction, the disconnecting means being movable between the reverse gear and the ink ribbon take up spool with a time period, and means for retarding a reversal rotation start timing of the press roller and the tape feed roller, a retarding period being greater than the time period.

In accordance with the first aspect of the present invention, the ink ribbon and the print tape are transportable in the forward direction. Further, the ribbon take up means is stopped when the tape transport means operates to transport the print tape in the reverse direction. Therefore, after once printing an image, such as a character train, following the lengthwise direction of the print tape, the print tape is again rewound only a predetermined distance and complicated printing operations such as printing ornamental images around the printed image, again printing the same printed image to produce bold characters, or printing a second line in the widthwise direction of the print tape, can be executed simply.

Even if the print element and a cutting mechanism for cutting the end of the print tape are arranged at positions spaced far away from each other in the direction in which the print tape is transported, after a printed print tape is cut, printing can be started near the edge of the cut edge of the unprinted print tape. This prevents generation of a wasteful margin at both ends of print tapes printed with row-shaped images such as characters. Therefore print tape is not wastefully consumed. Further, platen moving means moves the platen away from the print element when the printed tape is reversely transported. Therefore, the separation between the platen from the print element can prevent the ink ribbon from being reversely fed. Further, the platen moving means can move the platen away from the print element if the tape printing operation is not carried out even in the case the tape cassette is installed in the cassette receiving portion. Therefore, the unwanted deformation of the platen can be avoided.

In accordance with the second aspect of the present invention, for installing the tape cassette in the cassette receiving portion, the cover is opened. In accordance with the opening movement of the cover, the platen and the press roller are moved away from the print element and the tape feed roller. These movements can facilitate setting of the print tape of the tape cassette at a tape transporting path between the print element and the platen and between the tape feed roller and the press roller. Accordingly, an operator can quickly mount or dismount the tape cassette into and from the cassette receiving portion.

In accordance with the third aspect of the invention, a surface parallelism can be provided between the platen and the print element. The platen has a platen gear engaged with a gear train driven by a drive motor, so that the platen is rotatable about its axis. The platen gear is normally provided at one axial end portion of the platen. In this case, reactive force may be generated between the platen gear and the gear train due to the meshing engagement. The reactive force may tilt or move the platen with respect to the print element. In the present invention, however, there is provided means for directing the platen in parallel with the printing surface when the platen nips the print tape with respect to the printing surface of the print element. In equivalent manner, a surface parallelism can be provided between the press roller and the tape feed roller.

In accordance with a fourth aspect of the present invention, when the reversible drive motor is reversely rotated for reversely feeding the print tape, the reversal rotation timing of the tape spool is delayed or retarded, since it takes several time for moving the disconnecting means from the ink ribbon take up spool to the reverse gear of the tape spool. This delay may cause insufficient rewinding of the print tape. However, in the present invention, since reversal rotation start timing of the tape feed roller and the press roller is also retarded, and this retard period is greater than the moving period of the disconnecting means. Therefore, the print tape can be rewound around the tape spool without any slack.

DETAILED DESCRIPTION OF THE PREFERRED EMBODIMENTS

Figure 1:
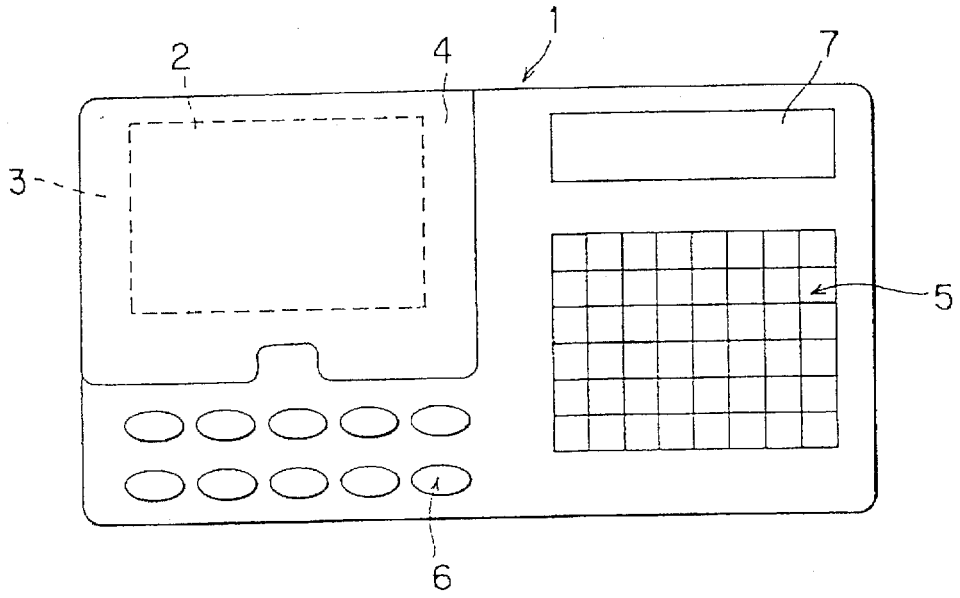
FIG. 1 is a schematic plan view showing a tape printer according to the present invention.

A tape printer according to one embodiment of the present invention will be described. FIG. 1 shows an external view of a tape printer body 1 formed of a synthetic resin. A receiving portion 3 for receiving a cassette 2 (to be described later) is provided at one side in the upper surface of the body 1. A freely openable and closable cover 4 is provided for covering the receiving portion 3. Also provided at the upper surface of the body 1 are a keyboard 5 for inputting characters and the like, a switch panel 6 with switches for performing various operations, and a liquid crystal display 7 for displaying operation commands, inputted characters, and the like. The interior of the printer body 1 is provided with a mechanical arrangement (to be described later), and a microcomputer (not shown) for control operations of the tape printer.

Figure 2:
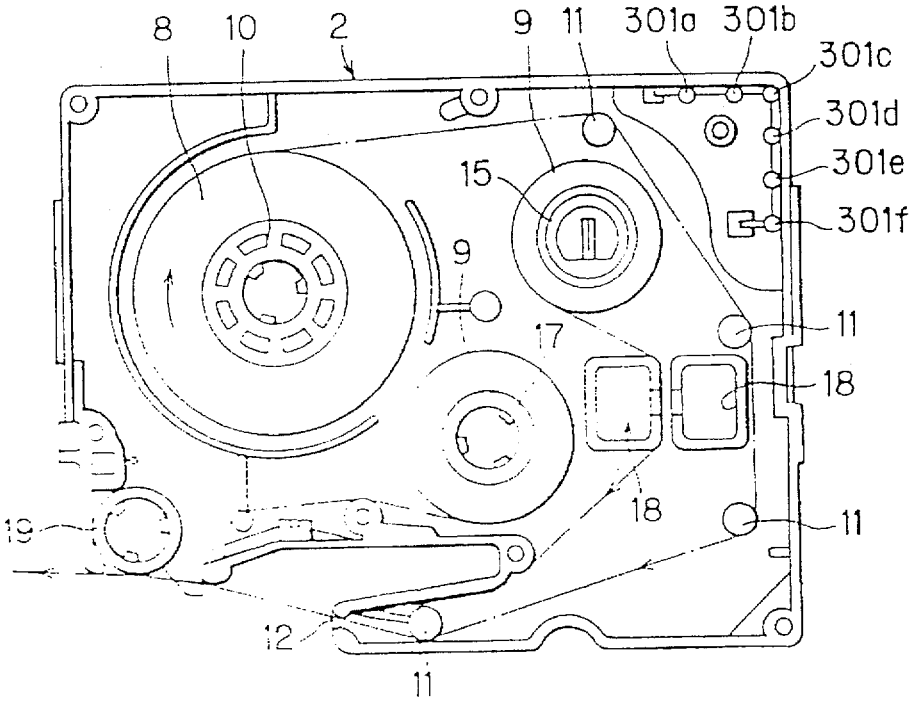
FIG. 2 is a plan view showing a cassette with its lid removed.

An internal arrangement of the tape cassette 2 is shown in FIG. 2. A receptor type print tape 8 and an ink ribbon 9 are accommodated in the cassette 2. The print tape 8 is wound on a tape spool 10. Four rollers 11 are provided for guiding travel of the print tape 8. The cassette 2 has a tape release portion 12 from which the print tape 8 is discharged from a cassette case body. The print tape 8 running along the four rollers 11 is transported by tape transport means (described later) and passes along a print portion 13 such as a thermal head (see FIG. 4).

The ink ribbon 9 is wound around a ribbon spool 15. Openings 18 are opened in the case body side of the cassette 2 at positions confronting a detection means 16, such as photo interrupters, in the receiving portion 3. The ink ribbon 9 is adapted to run through a detection path that passes between the detection means 16 and is guided past the print portion 13 and the release portion 12 in a path substantially parallel to path of the print tape 8. A ribbon tape up spool 17 is provided for taking up the ink ribbon 9 after it passes by the print portion 13. Also, a tape feed roller 19 is provided to the cassette 2 as one component of the tape transport means.

Figure 3:
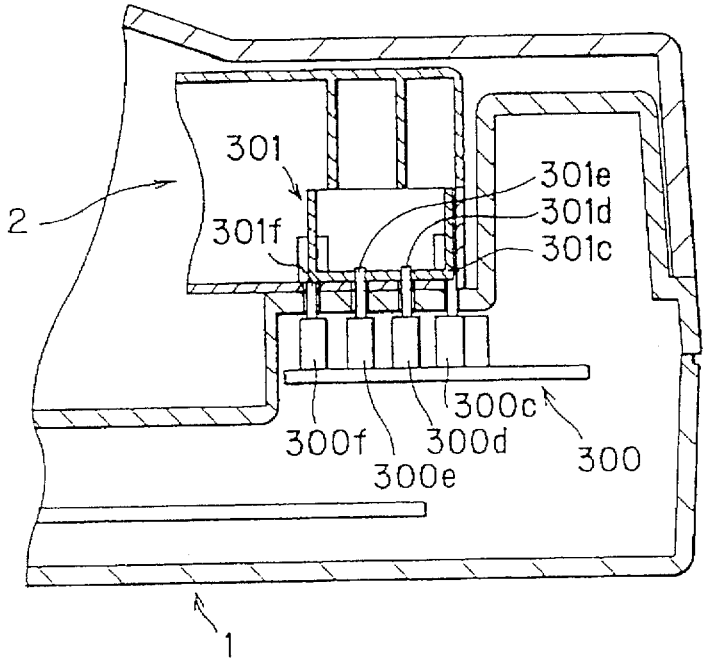
FIG. 3 is a cross-sectional view showing a mechanism for detecting the type or kind of print tape when the tape cassette is installed in the tape printer.

A sensor part 301 is provided to the cassette 2. The sensor part 301 includes six detected positions 301*a* through 301*f*, whose positions are predetermined so as to indicate the widthwise dimension of print tape 8, the variety (receptor type print tape on which positive images are printed or laminate type print tape on which mirror images are printed) of the print tape 8, and the ink color of the mounted ink ribbon 9. The sensor part 301 is positioned so as to be detectable by detection switches 300*a* through 300*f* (FIG. 3 does not show switches 300*a* and 300*b*) that are provided to the printer body 1. If no hole is opened at a sensor part, the corresponding detection switch is turned ON. If a hole is opened at a sensor part, the corresponding detection switch is turned OFF. For example, FIG. 3 shows detection switches 300*c* and 300*f* in an ON condition and detection switches 300*d* and 300*e* in an OFF condition.

The following Table 1 shows the relationship between ON or OFF conditions of the detection switches 300*a* through 300*f* and the kind of the tape cassette 2, i.e., ink color, tape variety, and tape width of tapes.

TABLE 1

| Ribbon color | | | Tape width | | | Tape variety | | |
|---|---|---|---|---|---|---|---|---|
| | 300a | 300b | | 300c | 300d | | 300e | 300f |
| single black/red | ON | ON | 32 mm | ON | ON | receptor laminate | ON | ON |
| | ON | OFF | 24 mm | ON | OFF | | ON | OFF |
| black/blue | OFF | ON | 18 mm | OFF | ON | cassette is not provided | OFF | OFF |
| red/blue | OFF | OFF | 12 mm | OFF | OFF | | | |

Next, internal structure of the tape printer will be described with reference to FIGS. 4 through 6. Incidentally, regarding the receptor-type print tape 8, printing is performed on the surface of the print tape 8 that confronts the ink ribbon 9. The other surface of the print tape 8 is precoated with an adhesive layer. A peelable tape is impermanently adhered to this adhesive layer.

The print tape transport means and the ink ribbon take up means will first be described. The printer body 1 has a frame 20 to which provided are a tape reverse drive cam 21 capable of engaging with the inner peripheral surface of the tape spool 10, a ribbon drive cam 22 for engaging with the inner peripheral surface of the ribbon take up spool 17, a tape drive cam 23 for engaging with an inner peripheral surface of the tape feed roller 19, and the print element 13, such as a thermal head. A bidirectional tape drive motor 24 is provided, and a gear train 80, 81, 82, 83, 84, 85, 86, 87, and 88 is provided for transmitting rotational force of the bidirectional tape drive motor 24 to the tape drive cam 23.

A press roller 26 is positioned in confrontation with the tape feed roller 19 (when the cassette is installed) to nip the print tape 8. Further, a gear 89 is provided for transmitting rotation of the gear 87 of the gear train to a platen gear 90. A swing arm 91 is provided coaxially with the gear 85 of the gear train. A planetary gear 92 is rotatably supported at a free end of the swing arm 91, and is meshedly engageable with the gear 85. The planetary gear 92 is also engageable with a ribbon drive gear 93. The ribbon drive gear 93 is connected to the ribbon drive cam 22 through a clutch spring (not shown). A meshing gear 96 is provided at one axial end of the press roller 26. The meshing gear 96 is meshedly engageable with the gear 88 of the gear train, so than the tape feed roller 19 and the press roller 26 are rotatable in synchronism. Further, an idler gear 94 is meshedly engageable with the planetary gear 94. The idler gear 94 is also engageable with a reverse gear 95 provided coaxially with the gear 86 of the gear train. The reverse gear 95 is connected to the tape reverse drive cam 21 through a clutch spring (not shown).

When the cassette 2 is mounted in the printer body 1 and printing operations are performed while the print tape 8 is transported in the direction in which the print tape 8 is drawn from the cassette 2 (i.e., the forward direction), the platen 25 (to be described later) presses against the print element 13 so as to sandwich the print tape 8 and the ink ribbon 9 between itself and the print element 13. Further, the press roller 26 (described later in detail) is caused to approach the tape feed roller 19 so as to sandwich the printed print tape 8 therebetween. The tape drive motor 24 is rotated in a normal direction (in the clockwise direction shown by the arrow A in FIG. 4). The rotation force of the tape drive motor 24 is transmitted to the platen gear 90 via the gear train 80 through 88 and the gear 89.

Figure 4:
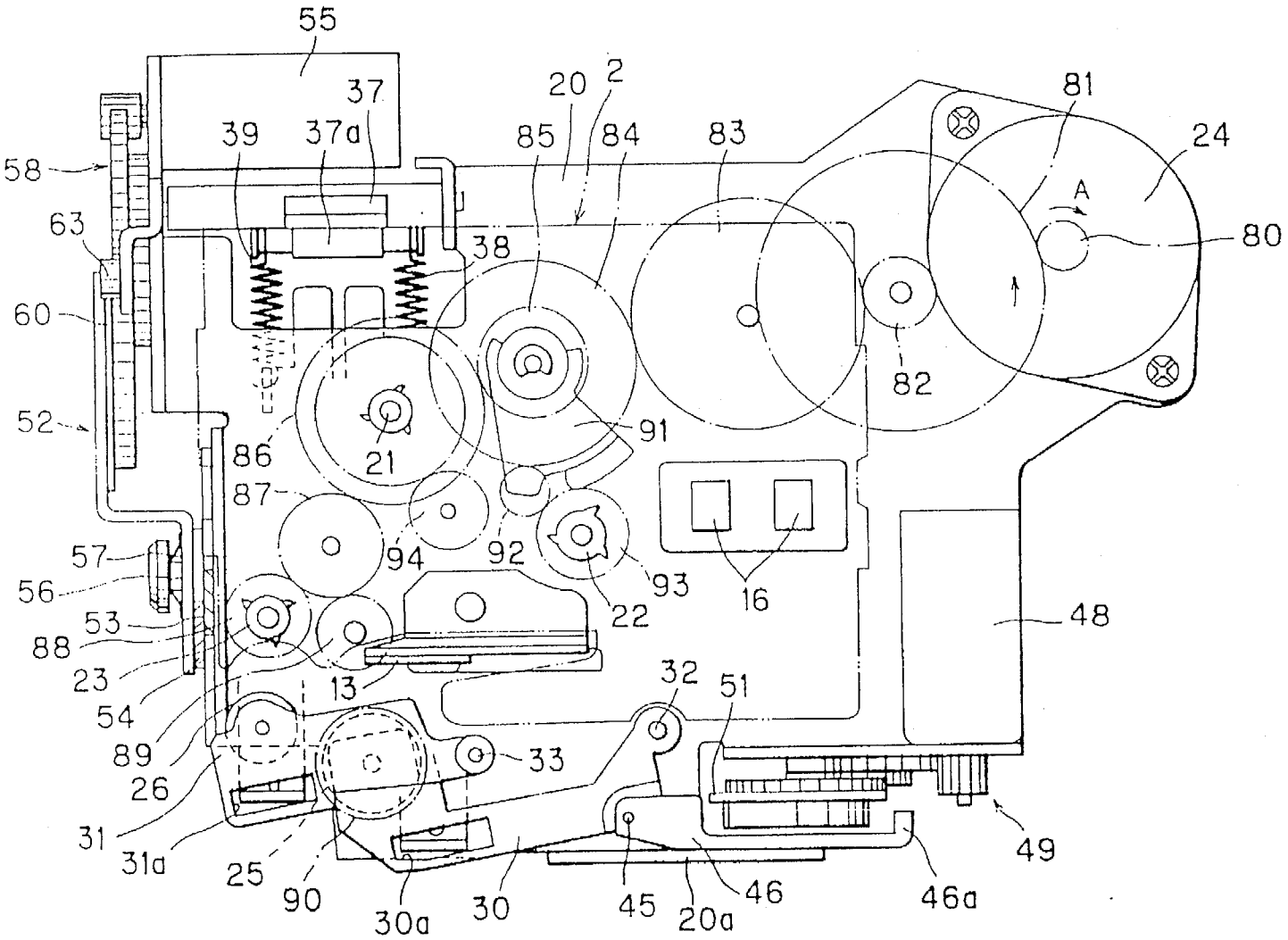
FIG. 4 is a plan view showing mechanical arrangement in a main body of the tape printer and showing a print tape feeding operation in a forward direction.
Figure 5:
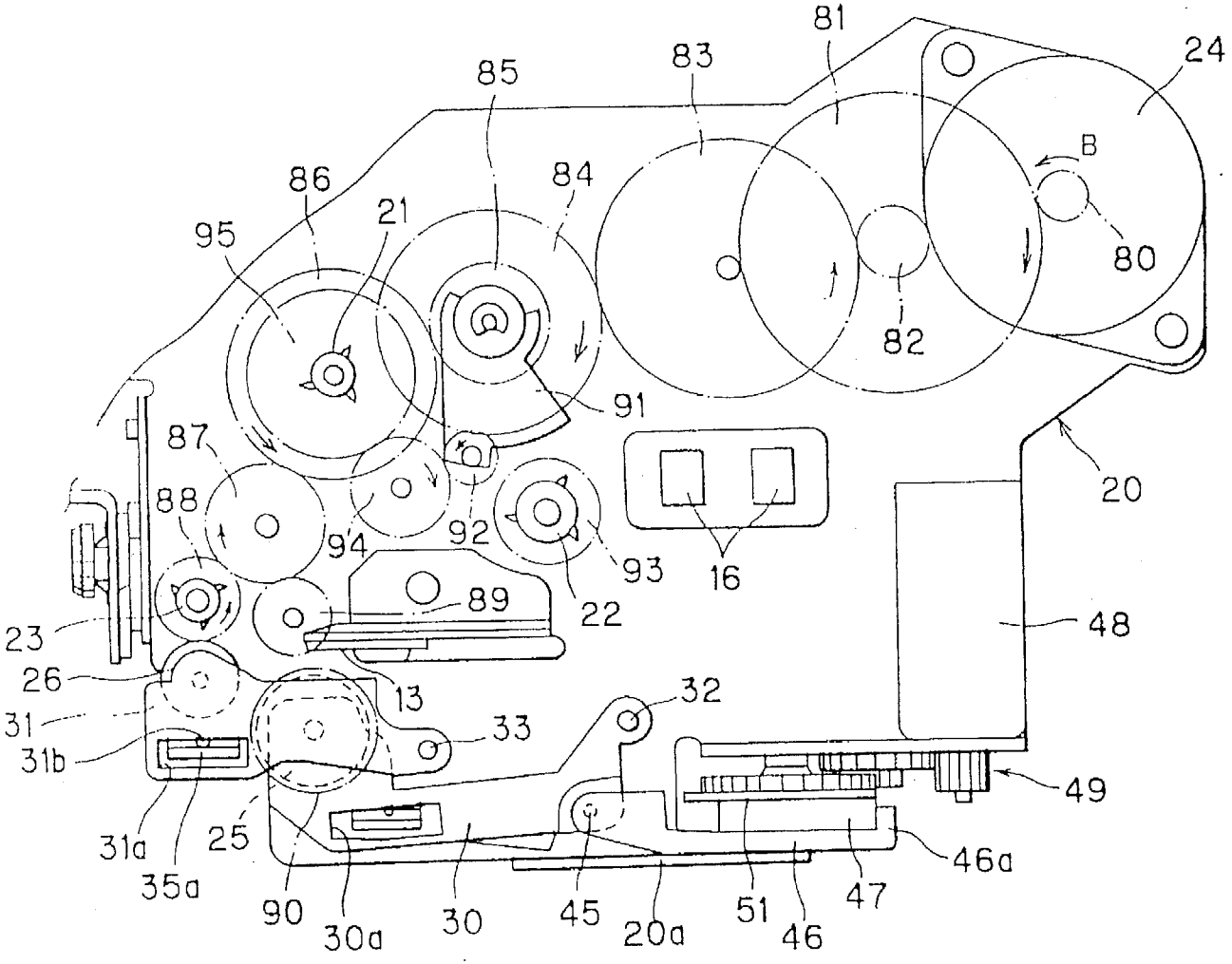
FIG. 5 is a plan view showing the released condition of a platen holder while feeding the print tape in the reverse direction.
Figure 7:
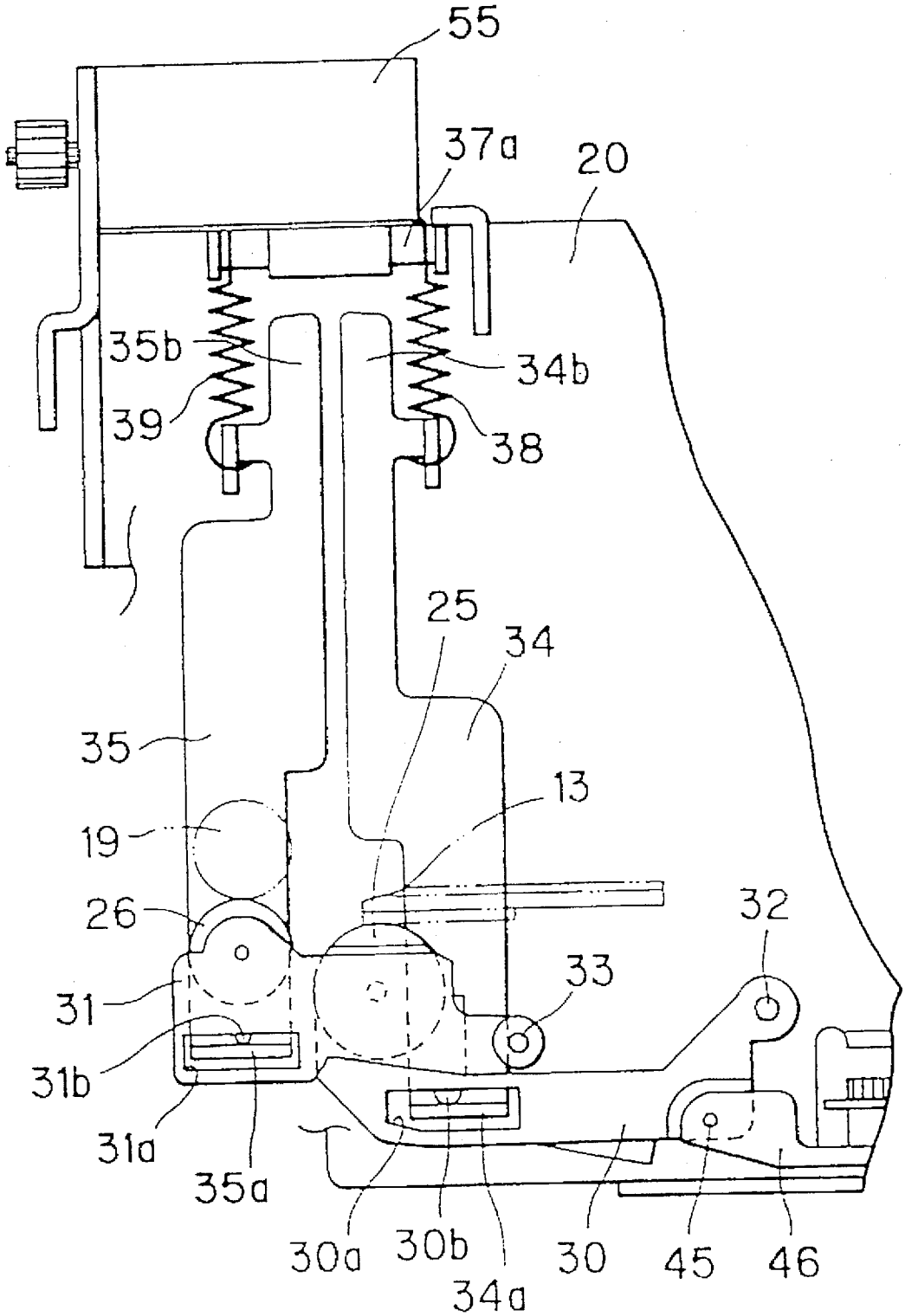
FIG. 7 is a plan view showing operation of the cover and an interlocking mechanism of a press roller holder and a platen holder.

At the same time, since the gear 85 rotates in the counterclockwise direction in FIG. 4 because of the normal rotation of the tape drive motor 24. Therefore, the swing arm 91, which is concentrically fixed to gear 85, is angularly moved in the counterclockwise direction. Therefore, the planetary gear 92 rotates the ribbon drive gear 93 in the counterclockwise direction, so that the ink ribbon 9 is wound over the ribbon take up spool 17. In this case, the amount of ink ribbon 9 taken up over a unit of time increases with increase in the diameter of the ink ribbon 9 taken up on the ribbon take up spool 17. However, high speed rotation of the ribbon drive gear 93 cannot be directly transmitted to the ribbon drive cam 23 because of the provision of the clutch spring (not shown) which provides slippage therebetween. Because of the slipping rotation of the ribbon drive cam 22, loose winding of the ink ribbon 9 is prevented.

On the other hand, when printing operations are temporarily interrupted, and the print tape 8 is rewound (transported in the reverse direction), the ink ribbon 9 is irrotational. That is, the tape drive cam 23 and the tape reverse drive cam 21 are rotated in the counterclockwise direction shown in FIG. 5 so as to transport the print tape 8 in the reverse direction while it is sandwiched between the press roller 26 and the tape feed roller 19. To this effect, the tape drive motor 24 is reversely driven (that is, in the counterclockwise direction indicated by the arrow B in FIG. 5). Therefore, the gear 85 is rotated in the clockwise direction in FIG. 5. Accordingly, the swing arm 91, which is concentrically fixed to the gear 85, is also rotated in the clockwise direction. Consequently, the planetary gear 92 is disengaged from the ribbon drive gear 93, to thus stop rotation of the ribbon drive cam 22. The planetary gear 92 is brought into engagement with the idler gear 94, so that the planetary gear 92 rotates the reverse gear 95 in the counterclockwise direction via the idler gear 94. Thus, the tape reverse drive cam 21 is reversely driven so that the print tape 8 is wound onto the tape spool 10. In this case, the platen 25 is positioned away from the print element 13 as described later.

The swinging movement of the swing arm 91 toward the idler gear 94 requires several time period. Therefore, reverse rotation start timing of the tape drive cam 23 is delayed in comparison with the reverse rotation start timing of the tape feed roller 19, the press roller 26 and the platen 25. Due to this delay, the print tape 8 may be loosely wound in the cassette 2. To avoid this problem, in the illustrated embodiment, there is provided a rotation delaying mechanism for delaying reverse rotation start timing of the tape feed roller 19 and the press roller 26.

Figure 8:
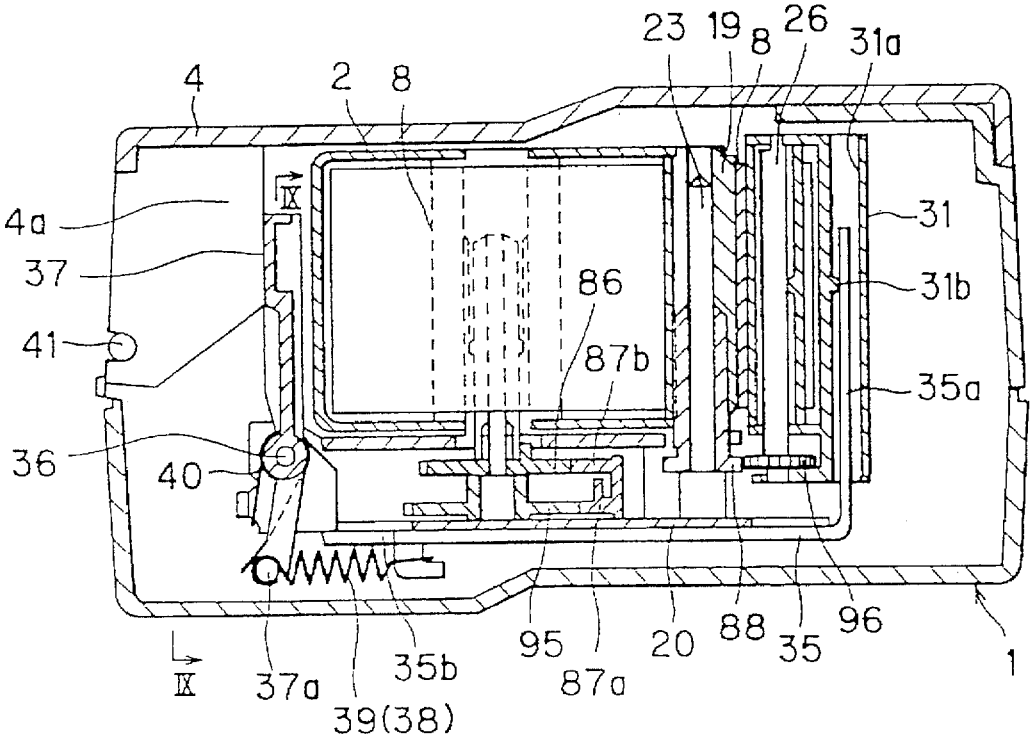
FIG. 8 is a cross-sectional side view showing a closed condition of the cover.
Figure 9:
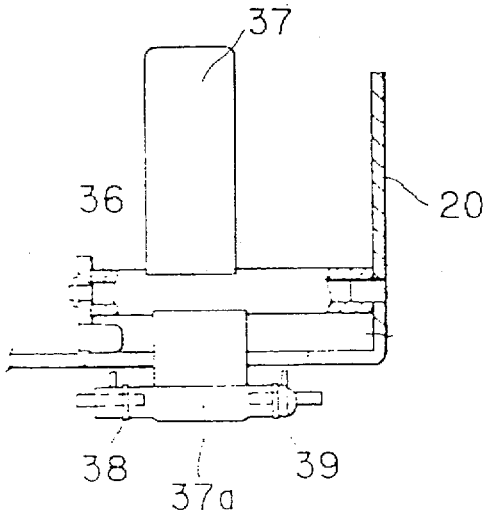
FIG. 9 is a cross-sectional view taken along the line IX—IX of FIG. 8.
Figure 25:
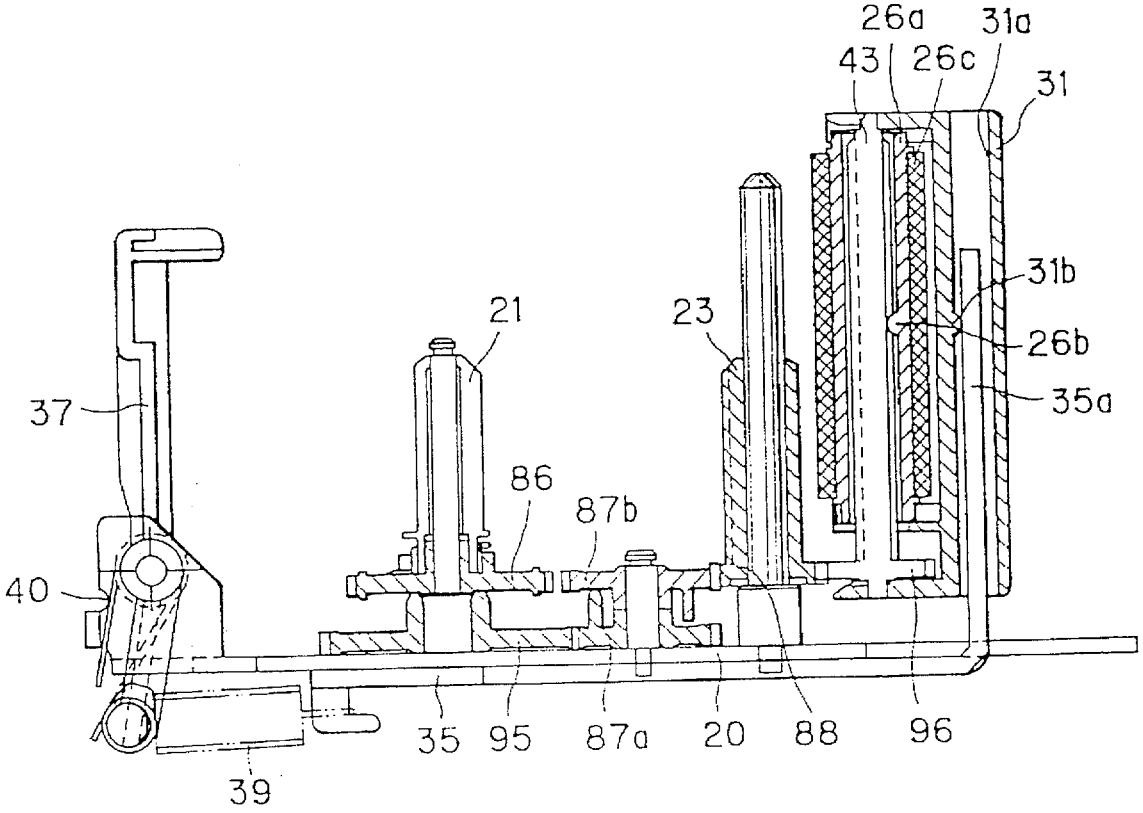
FIG. 25 is a cross-sectional side view showing a closed condition of the cover and particularly showing a rotation delaying mechanism.
Figure 26:
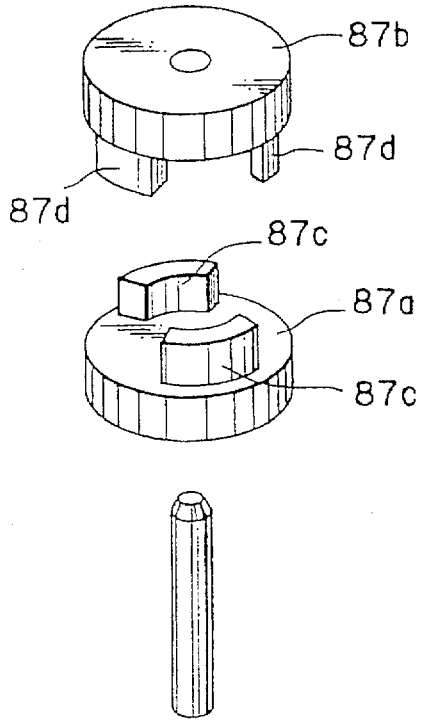
FIG. 26 is a perspective view of gears in the delaying mechanism.

As shown in FIGS. 8, 25 and 26, the gear 87 the gear train is constituted by first and second gears **87*a* and 87*b* where the gear 87*a* and the gear 87*b* are intermittently connected. That is, the first gear 87*a* is provided with a pair of arcuate ribs 87*c*, 87*c*, and the second gear 87*b* is provided with a pair of arcuate ribs 87*d*, 87*d*. A space is provided between the ribs 87*c* and 87*d* in a rotating direction of the gears 87*a* and 87*b*. Thus, the reverse rotation of the first gear 87*a* is not promptly transmitted to the second gear 87*b*. Thus, the gears 87*a* and 87*b* are connected such that the rotation of the gear 87*b* is suitably delayed with respect to the rotation of the gear 87*a*. The rotation of the tape drive motor 24 is transmitted to the gear 87*a*, and the gears 89 and 88, and the mesh gear 96 are driven by the gear 87*b*. Accordingly, the reverse rotation of the tape feed roller 19 and the press roller 26 is delayed with respect to the start of reverse rotation of the tape drive motor 24. The amount of delay is set greater that the time of delay by the swing of the swinging arm 91. Therefore, the print tape 8 will not be loosely rewound in the cassette 2**.

Next, will be described an interlocking mechanism for moving the platen 25 and the press roller 26 when the cassette 2 is mounted and detached from the printer body 1 while referring to FIGS. 6 through 9. Pivot shafts 32 and 33 are provided to the frame 20. A press roller holder 31, on which the press roller 26 is mounted, is rotatably connected to the pivot shaft 33. A platen holder 30, on which the platen 25 is mounted, is rotatably connected to pivot shaft 32. Holes **30*a* and 31*a* are opened in the platen holder 30 and the press roller holder 31** respectively.

A roller operation lever 35 and a platen operation lever 34 are arranged to the rear surface (lower surface) of the frame 20. The roller operation lever 35 and the platen operation lever 34 are L-shaped in cross-section as best shown in FIG. 6. upstanding tip portions **35*a* and 34*a* of the roller operation lever 35 and the platen operation lever 34 are positioned into holes 30*a* and 31*a* respectively. Protrusion 30*b* and 31*b*, which abut one surface (the pressing surface) of the tip portions 34*a* and 35*a*, are integrally formed in each hole 30*a* and 31*a***.

The platen operation lever 34 and the roller operation lever 35 are positioned so as to be movable parallel with the rear surface of the frame 20. A pivot shaft 36 extends horizontally from the frame 20, and an interlocking lever 37 having a lower attachment portion **37*a* is rotatably supported on the shaft 36. A torsion spring 40 is disposed at a pivot portion of the interlocking lever 37 so as to urge the interlocking lever 37 to pivotally rotate in the counterclockwise direction in FIGS. 6 and 8. The platen operation lever 34 and the roller operation lever 35 are connected to the lower attachment portion 37*a* through tension springs 38 and 39, respectively. The platen operation lever 34 and the roller operation lever 35 have another ends each confronting the lower attachment portion 37*a* of the interlocking lever 37**.

A cover body 4 is provided to cover the tape cassette receiving portion 3. The cover body 4 has an abutment portion **4*a* abuttable on the interlocking lever 37. The abutment portion 41 protrudes from the inner surface of the cover body 4. Further, a hinged pin 41 is provided to the frame 20 for pivotally moving the cover body 4**.

When cover body 4 covers the receiving portion 3 as shown in FIG. 8, the back side (left side face in FIG. 8) of the interlocking lever 37 is pressed by the abutment portion **4*a* in a clockwise direction in FIG. 8. Therefore, the attachment portion 37*a* of the interlocking lever 37 is moved leftwardly in FIG. 8. As a result, both the platen operation lever 34 and the roller operation lever 35 are moved toward left in FIG. 8 through the tension springs 38, 39. Consequently, the platen holder 30 is pivotally moved about the pivot shaft 32 toward the printing element 13 because of the engagement between the hole 30***a* and the upstanding tip end 34*a*, and the press roller holder 31 is pivotally moved about the pivot shaft 33 toward the tape feed roller 19 because of the engagement between the hole 31*a* and the upstanding tip end 35*a*. Thus, the print tape 8 and the ink ribbon 9 can be nipped between the platen 25 and the print element 13, and the print tape 8 can be nipped between the press roller 26 and the tape feed roller 19.

Figure 6:
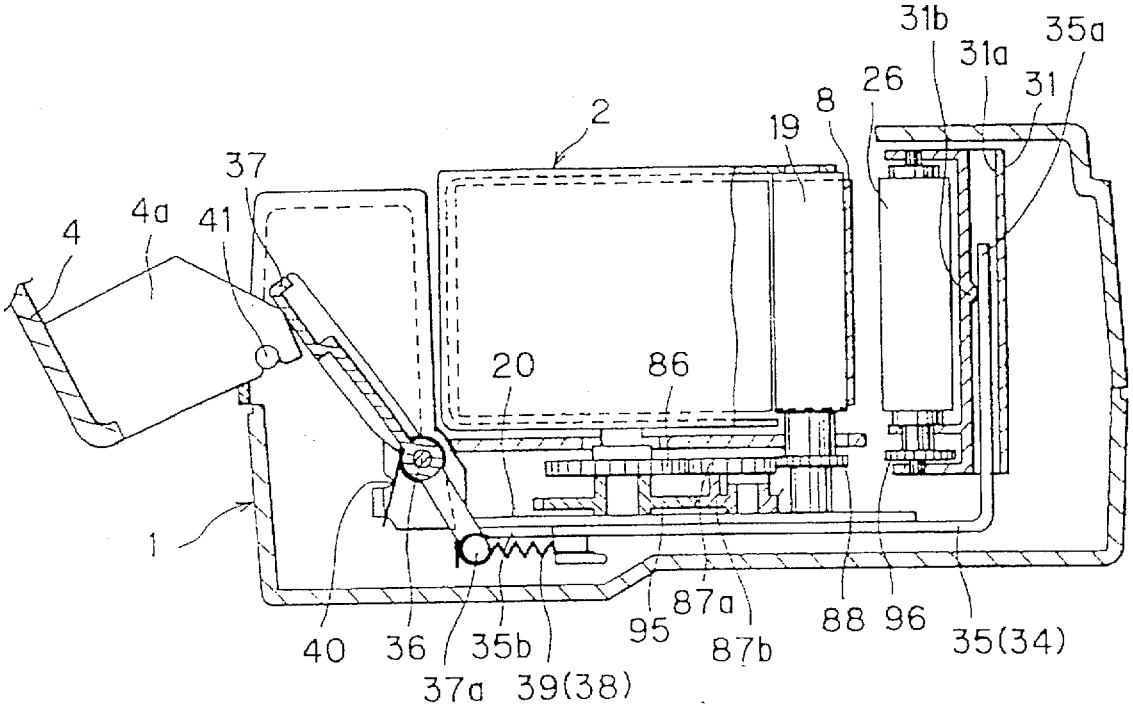
FIG. 6 is a cross-sectional side view showing an open condition of the cover.

On the other hand, when the cover body 4 is opened by rotating on the hinged pin 41 as shown in FIG. 6, the interlocking lever 37 is released from the abutment portion 4*a* of the cover 4, and rotates as shown in FIG. 6 by the biasing force of the torsion spring 40. This loosens the urging force produced by the tension springs 38 and 39. Also, when the interlocking lever 37 is rotated into the condition shown in FIG. 6, the front surface of the lower tip attachment portion 37*a* of the interlocking lever 37 pushes the other en faces 34*b* and 35*b* of both operation levers 34 and 35. Therefore, the upstanding tip portions 34*a* and 35*a* of the operation levers 34, 35 respectively press into the holes 30*a* and 31*a* of the platen holder 30 and the press roller holder 31. Thus, the platen holder 30 and the press roller holder 31 are forcibly rotated to a direction away from the printing element 13 and the tape feed roller 19.

Figure 10:
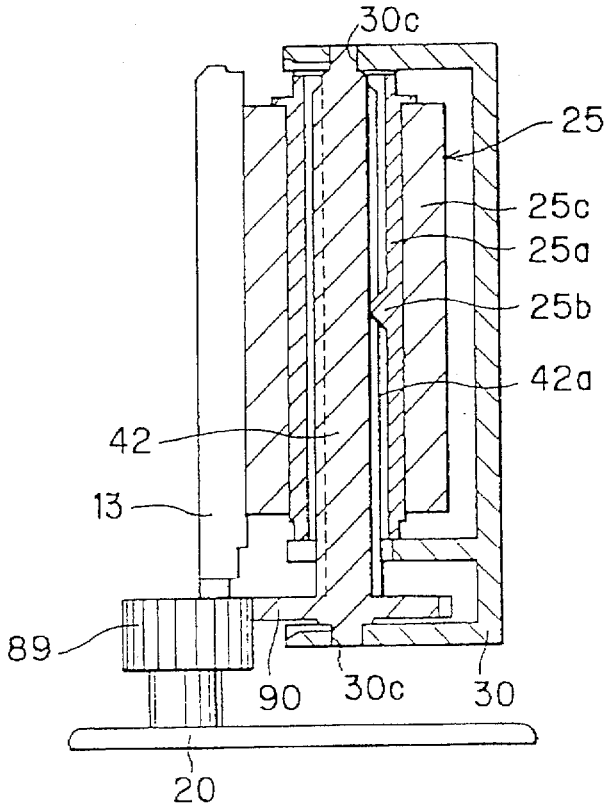
FIG. 10 is a cross-sectional view showing an essential portion of the platen holder.
Figure 11:
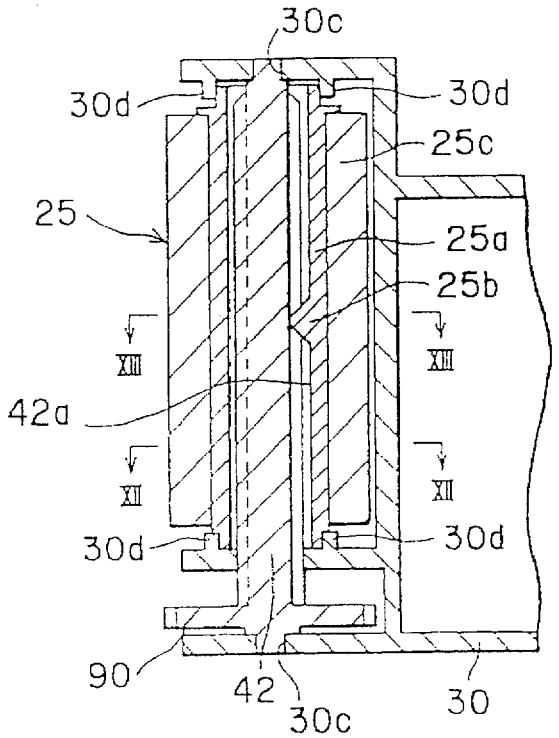
FIG. 11 is a cross-sectional view taken along the line XI—XI of FIG. 10.
Figure 12:
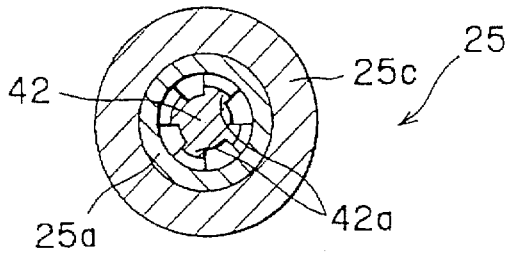
FIG. 12 is a cross-sectional view taken along the line XII—XII of FIG. 11.
Figure 13:
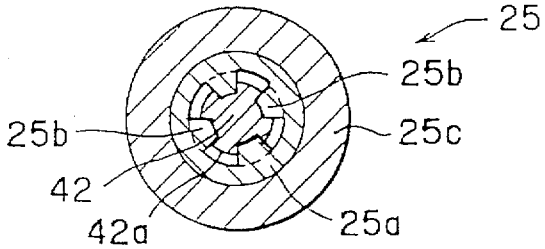
FIG. 13 is a cross-sectional view taken along the line XIII—XIII of FIG. 11.
Figure 14:
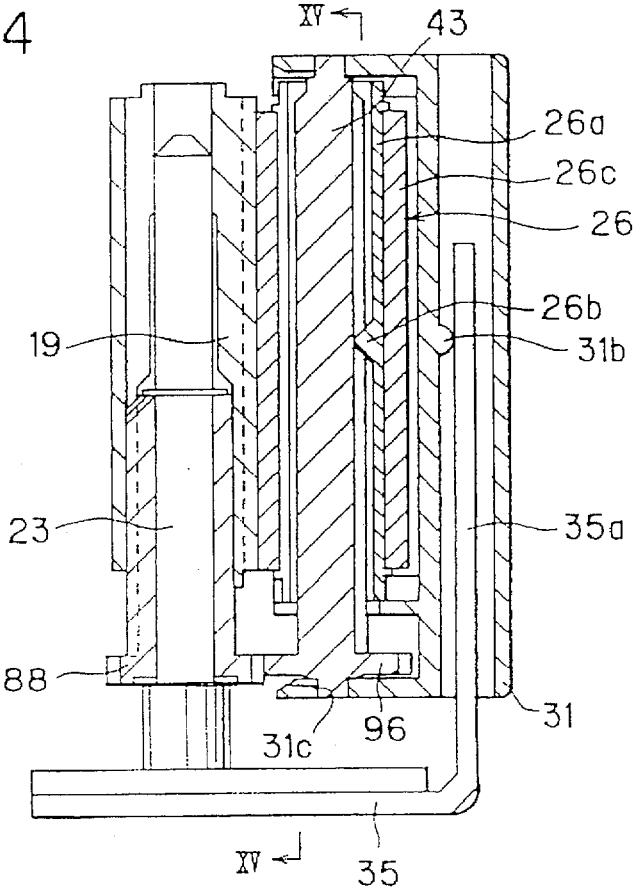
FIG. 14 is a cross-sectional view showing an essential portions of a press roller holder.
Figure 15:
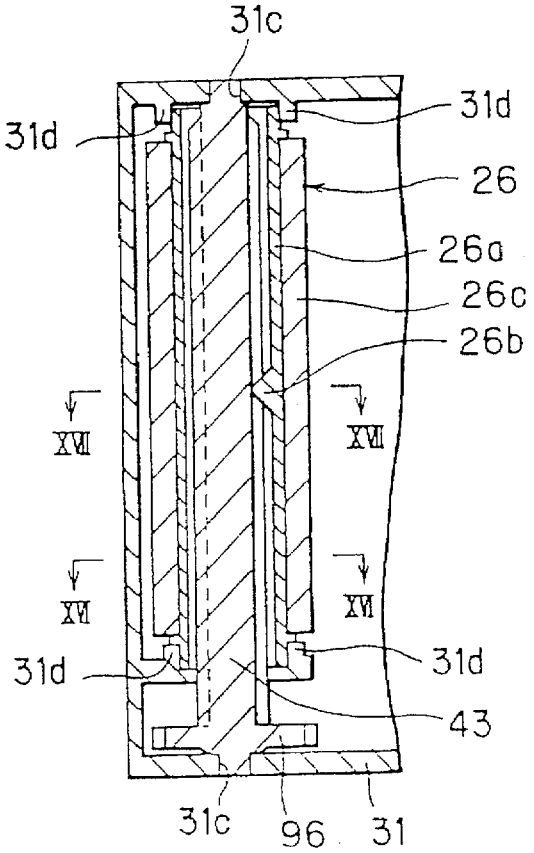
FIG. 15 is a cross-sectional view taken along the line XV—XV of FIG. 14.
Figure 16:
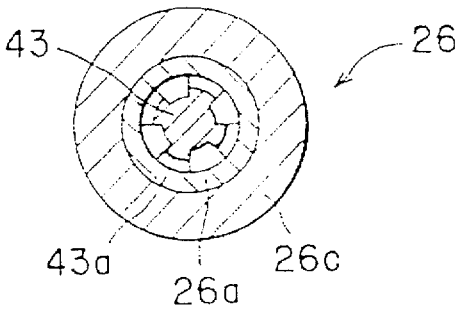
FIG. 16 is a cross-sectional view taken along the line XVI—XVI of FIG. 15.
Figure 17:
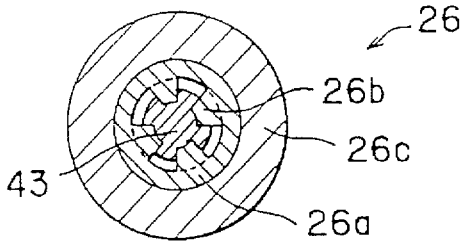
FIG. 17 is a cross-sectional view taken along the line XVII—XVII of FIG. 15.

As best shown in FIG. 10, the platen 25 is integrally provided with a platen gear 90 disposed at axially one end portion of the platen 25, and driving force of the gear 89 is transmitted to the platen gear 90. Further, as best shown in FIG. 14, the press roller 26 is integrally provided with the mesh gear 96 disposed at axially one end portion of the press roller 26, and driving force of the gear 88 is transmitted to the mesh gear 96. With this arrangement, the meshing engagement between the gears 89 and 90 and between the gears 88 and 96 may provide reactive force, so that each axially one end portion of the platen 25 and the press roller 26 may lift from the surface of the print element 13 and the tape feed roller 19, respectively. This makes it difficult to produce a uniform nipping pressure in the widthwise direction of the print tape 8 and the ink ribbon 9. In light of this, the present embodiment further provides self-centering mechanism in the platen 25 and the press roller 26 so as to provide uniform nipping pressure in the widthwise direction of the tape 8.

More specifically, the platen 25 includes a spline shale 42, an inner cylinder body 25*a* disposed over the spline shaft 42, and an outer cylinder body 25*c* disposed over the inner cylinder body 25*a*. The spline shaft 42 has a spline portion 42*a* at its outer periphery thereof. One end of the spline shaft 42 is integrally provided with the platen gear 90. The platen holder 30 is formed with attachment holes 30*c*, 30*c* and is provided with ribs 30*d*, 30*d*. Each axial end of the spline shall 42 is supported by the attachment holes 30*c*, 30*c*. Further, each axial end portion of the inner cylinder body 25*a* is guided by the rib 30*d* so as to be movable in the direction for pressing against the print element 13. Further, the ribs 30*d*, 30*d* prevents the inner cylinder body 25*a* from being moved in the direction perpendicular to the pressing direction, i.e., the direction in which the print tape 8 moves.

An inner cylinder body 25*a* is loosely engaged with the spline portion 42*a*. A plurality of engagement protrusions 25*b* are provided at the inner diameter portion of the inner cylinder 25*a*. The protrusions 25*b* protrude radially inwardly at a position substantially at a central portion with respect to the length of the platen 25. The protrusions 25*b* are engageable with the grooves of the spline portion 42*a*. Thus, the platen 25 can rock on the engagement protrusions 25*b* with respect to an axis of the spline shaft 42 (see FIGS. 10 through 13). When, via the platen holder 30, the platen 25 moves toward the print element 13 (to the left in FIG. 10) and presses against the print element 13, the platen gear 90 side of the axis of the spline shaft 42 may be moved in the direction away from the print element 13 due to the above-described reactive force. However, since the platen 25 is self-centered on the engagement protrusion 25*b*, the platen 25 is pressed parallel to the surface of the print element 13. Accordingly, the pressing force in the widthwise direction of the print tape and the ink ribbon 9 between the print element 13 and the platen 25 can therefore be made uniform.

A similar structure can be applied to the press roller 26 in the press roller holder 31. The press roller 26 includes a spline shaft 43, an inner cylinder body 26*a* disposed over the spline shaft 43, and an outer cylinder body 26*c* disposed over the inner cylinder body 26*a*. The spline shaft 43 has a spline portion 43*a* at its outer periphery thereof. One end of the spline shaft 43 is integrally provided with the mesh gear 96. The press roller holder 31 is formed with attachment holes 31*c*, 31*c* and is provided with ribs 31*d*, 31*d*. Each axial end of the spline shaft 43 is supported by the attachment holes 31*c*, 31*c*. Further, each axial end portion of the inner cylinder body 26*a* is guided by the rib 31*d* so as to be movable in the direction for pressing against the tape feed roller 19. Further, the ribs 31*d*, 31*d* prevents the inner cylinder body 26*a* from being moved in the direction perpendicular to the pressing direction, i.e., the direction in which the print tape 8 moves.

An inner cylinder body 25*a* is loosely engaged with the spline portion 43*a*. A plurality of engagement protrusions 26*b* are provided at the inner diameter portion of the inner cylinder 26*a*. The protrusions 26*b* protrude radially inwardly at a position substantially at a central portion with respect to the length of the press roller 26. The protrusions 26*b* are engageable with the grooves of the spline portion 43*a*. Thus, the press roller 26 can rock on the engagement protrusions 26*b* with respect to an axis of the spline shaft 43 (see FIGS. 14 through 17). When, via the press roller holder 31, the press roller 26 moves toward the tape feed roller 19 (to the left in FIG. 14) and presses against the tape feed roller 19, the mesh gear 96 side of the axis of the spline shaft 43 may be moved in the direction away from the tape feed roller 19 due to the above-described reactive force. However, since the press roller 26 is self-centered on the engagement protrusion 26*b*, the press roller 26 is pressed parallel to the surface of the tape feed roller 19. Accordingly, the pressing force in the widthwise direction of the print tape between the tape feed roller 19 and the press roller 26 can therefore be made uniform.

Next, a platen moving mechanism will be described with reference to FIGS. 18 through 21. The platen moving mechanism is adapted to move the platen 25 toward and away from the printing element 13 when the print tape 8 of the tape cassette 2 installed in the cassette receiving portion 3 of the tape printer is moved in forward and rewinding or reverse direction, respectively.

As described above, when the tape cassette 2 is installed in the cassette receiving portion 3 and the cover 4 is closed, the interlocking lever 37 becomes vertical (FIG. 8) and the urging force of the tension spring 38 rotates the platen holder 30 via the platen operation lever 34. In this case, the platen 25 presses against the print element 13 (see FIG. 18). The platen moving mechanism allows the platen 25 to move away from the print element 13 even if the cover 4 is closed in order to prevent the ink ribbon 9 from being reversely fed by the platen.

A platen moving lever 46 is provided having a base end rotatably supported to a shaft 45 connected to the platen holder 30, and having a free end provided with an abutment portion 46*a*. A platen moving motor 48 is fixed to the frame 20, and a gear train 49 is provided to transmit the rotation of the platen moving motor 48 to a cam 47. The abutment portion 46*a* of the platen moving lever 46 is abuttable on a peripheral surface of the cam 47.

Figure 19:
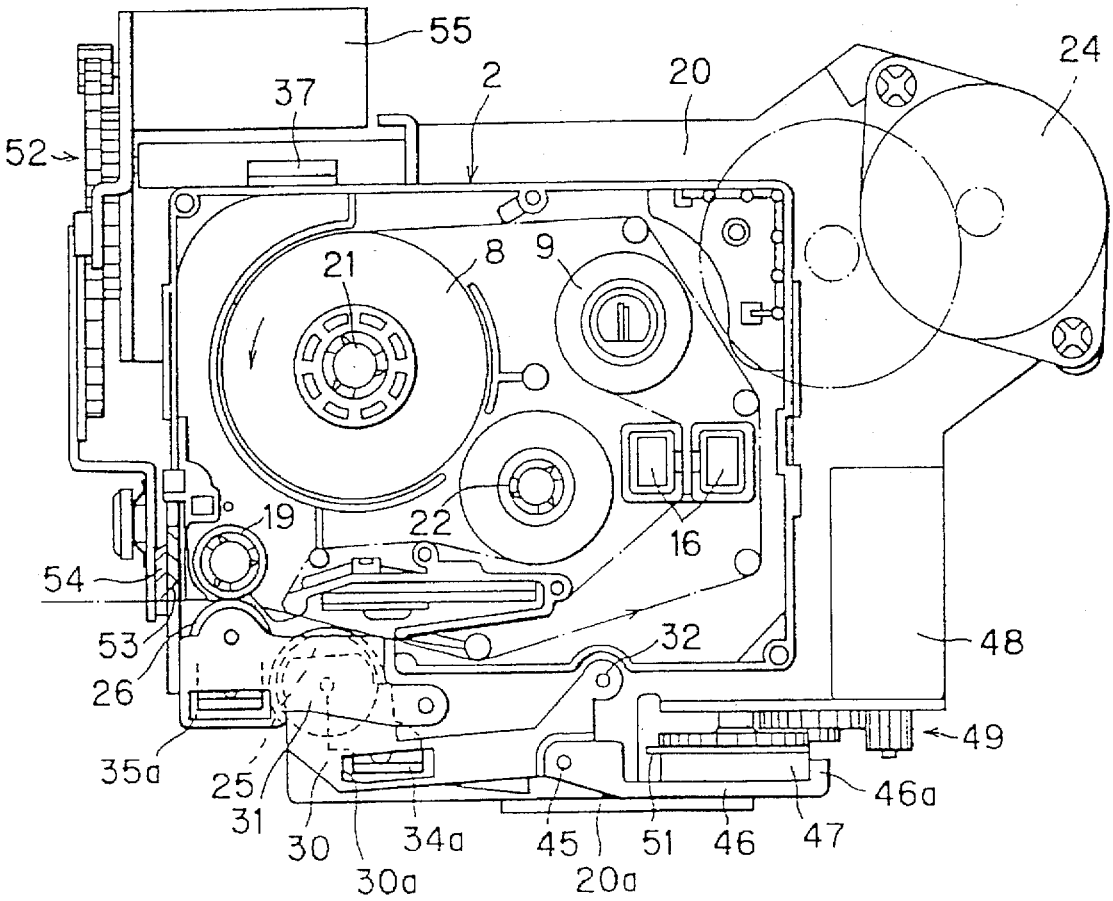
FIG. 19 is an explanatory plan view showing a condition when the print tape is transported in a reverse direction.
Figure 20:
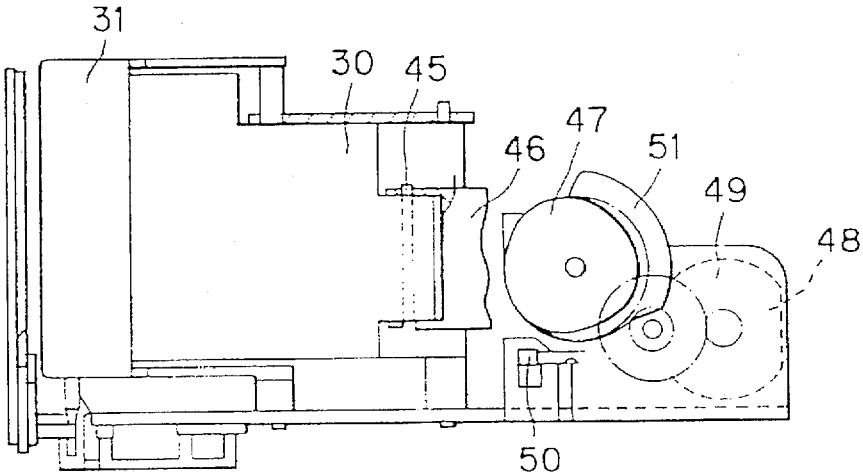
FIG. 20 is a view taken along the line XX—XX of FIG. 18.
Figure 21:
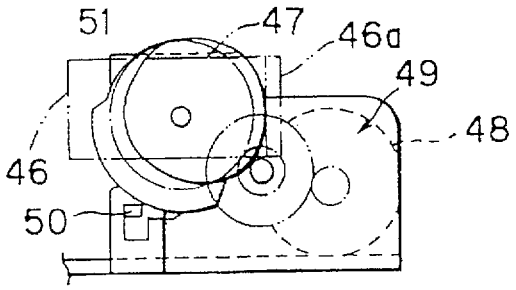
FIG. 21 is a front view showing a phase of a cam in a condition for operating the platen holder.

The platen moving lever 46 is positioned between the cam 47 and an upwardly bent portion 20*a* of the frame 20 so that range of movement of the platen moving lever 46 is restricted to only reciprocal movement in a direction parallel to the upwardly bent portion 20*a*. The cam 47 rotates unidirectionally (counterclockwise direction in FIG. 20) via the gear train 49 from the platen moving motor 48. The platen moving lever 46 is pulled rightward in FIG. 19 at a predetermined rotation phase position of the cam 47 so that the platen holder 30 moves away from the print element 13 against the biasing force of the tension spring 38. As shown in FIGS. 20 and 21, the cam 47 is integrally provided with a sensor plate 51, and a relief switch 50 is provided to detect the sensor plate 51.

Figure 18:
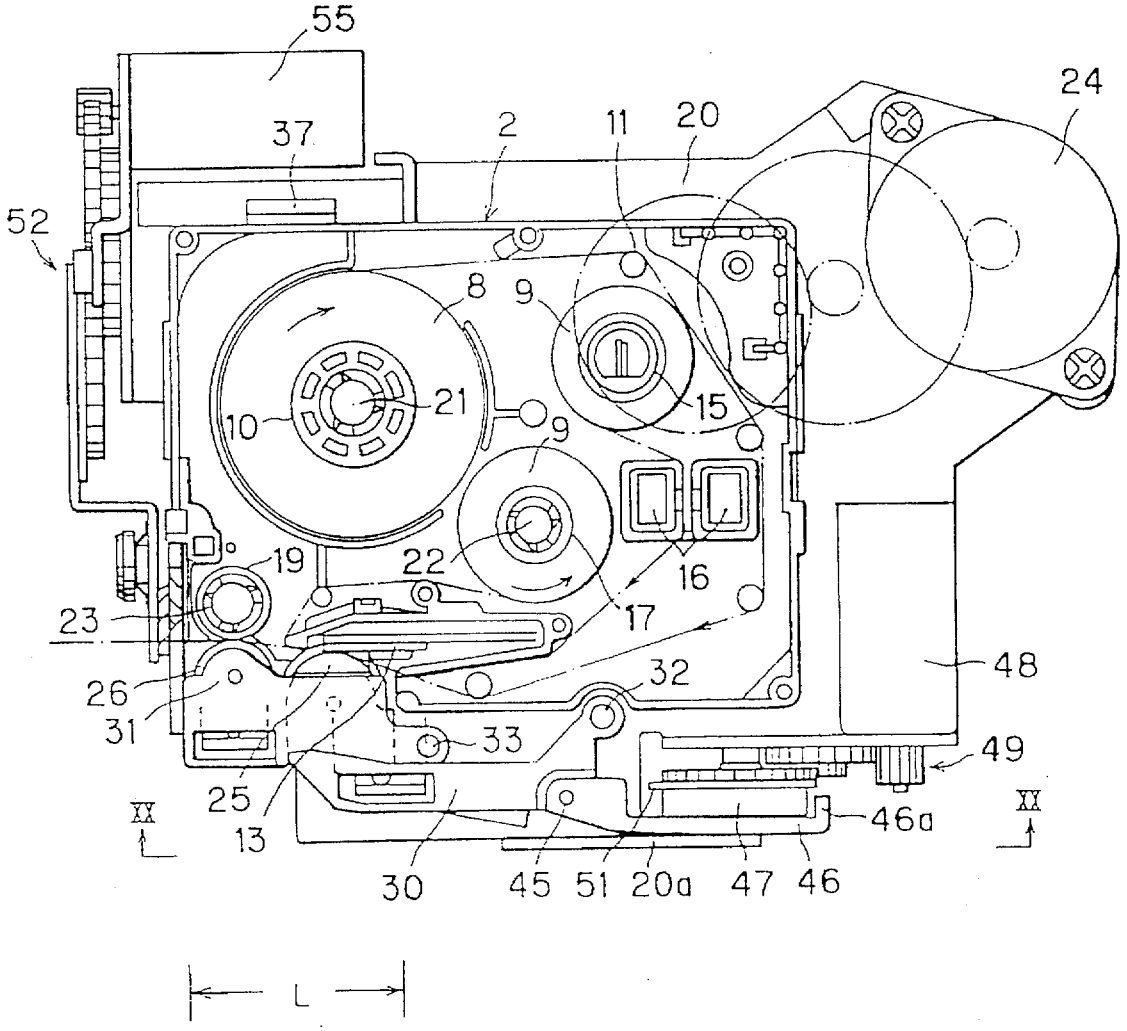
FIG. 18 is an explanatory plan view showing a condition when the print tape is transported in a forward direction.

Thus, the moving phase of the platen holder 30 is detected by detecting the rotation phase of the cam 47 using the ON/OFF status of the relief switch 50. That is, when the platen holder 30 is in a pressing condition against the print element 13 as shown in FIGS. 18 and 20, the tip of the sensor plate 51 does not abut the relief switch 50 and so the relief switch 50 is rendered OFF. For continuing printing operation, this state is maintained by deenergizing the platen moving motor 48 when the cam 47 is rotated to the position shown in FIG. 20.

The unidirectionally rotating platen moving motor 48 rotates in the counterclockwise direction in FIGS. 20 and 21. With counterclockwise rotation of the cam 47, the of the cam 47 presses the abutment portion 46*a* of the platen moving lever 46 in the rightward direction in FIG. 19. The platen holder 30 is moved away from the print element 13. At this time, the relief switch 50 is rendered ON by the sensor plate 51, so that the platen moving motor 48 is deenergized.

Accordingly, when the tape printer is not being used, while installing the tape cassette 2 in the cassette receiving portion 3, the platen 25 can be maintained separated from the print element 13. This prevents the platen 25, which is made from a soft material such as rubber, from being permanently deformed by being pressed against the surface of the print element 13. On the other hand, when the platen holder 30 is moving from the separated condition to the pressing condition, the relief switch 50 remains ON until the platen holder 30 is completely in a pressing condition, whereupon the relief switch is rendered OFF.

If the cam 47 is in the position shown in FIG. 21, while printing to the tape cassette 2 in the cassette receiving portion 3 is intended, the platen moving motor 48 is first energized in response to the depression of the print switch, and is then deenergized upon completion of 180 degree rotation to maintain the cam position shown in FIG. 20. Therefore, the platen 25 is positioned at its nipping position relative to the print element 13.

In the present embodiment, the platen holder 30 can be angularly moved to a position away from the print element 13 by the rotation of the cam 47. Also, the platen holder 30 and the press roller holder 31 can be angularly moved in the separation direction via the pressing operation lever 35, the platen operation lever 34, and the tension springs 38 and 39 in accordance with the opening and closing movement of the cover 4. Therefore, whether the operation of the platen moving motor 48 brings the platen holder 30 in the pressing condition or the separated condition, the platen holder 30 and the pressing holder 31 are forced to move into the separation condition when the cover 4 is opened. Therefore an operator can change cassettes 2 regardless of the rotational phase of the cam 47.

Figure 22:
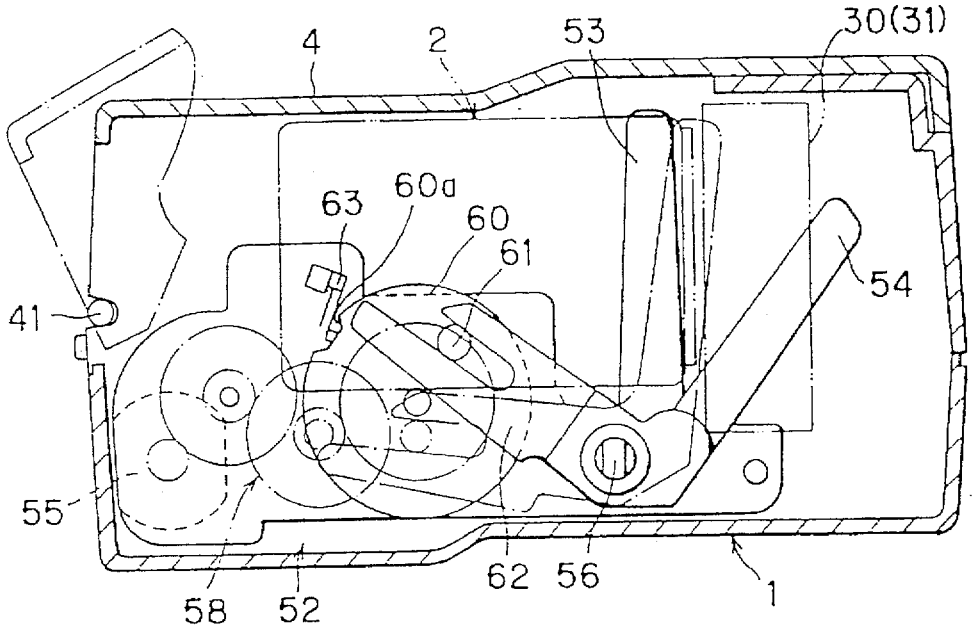
FIG. 22 is a front view showing a cutting mechanism for cutting the print tape.

Next, a cutting mechanism 52 for cutting the print tape 8 will next be provided with reference to FIGS. 4 and 22. The cutting mechanism 52 includes a fixed blade 53, a movable blade 54, and a cutter motor 55 for driving the movable blade 54. The fixed blade 53 is fixed to the upwardly protruding portion 20*b* of the frame 20. The movable blade 54 is rotatably mounted on a support shaft 56, which is adjacent to the fixed blade 53. The movable blade 54 has a connection arm 62 extending from the base end of the movable blade 54. The connection arm 62 is formed with a bifurcated portion. A spring washer 57 is provided for urging the movable blade 54 towards the fixed blade 53.

A disk-shaped operation disk 60 is rotatably supported on the frame 20. An engagement pin 61 protrudes from one surface of the operation disk 60. The disk 60 is formed with an indentation 60*a* in an outer peripheral surface thereof. Further, a cutter motor 55 is provided for unidirectionally rotating the disk-shaped operation disk 60 via a gear train 58. The engagement pin 61 is slidably freely engageable between the two prongs of the connection arm 62 for pivotally moving the movable blade 54. A relief switch 63 is provided to be engageable with the indentation 60*a*.

One rotation of the operation disk 60 moves the movable blade 54 from an open position as shown by the solid line in FIG. 22 to a temporary closed position as shown by the two dot chain line, and then again to the open position by the sliding engagement between the pin 61 and the connection arm 62. The relief switch 63 turns OFF when it abuts the indentation 60*a*. Therefore, the cutter motor 55 is deenergized for stopping the movable blade 54 at its open position.

Figure 23:
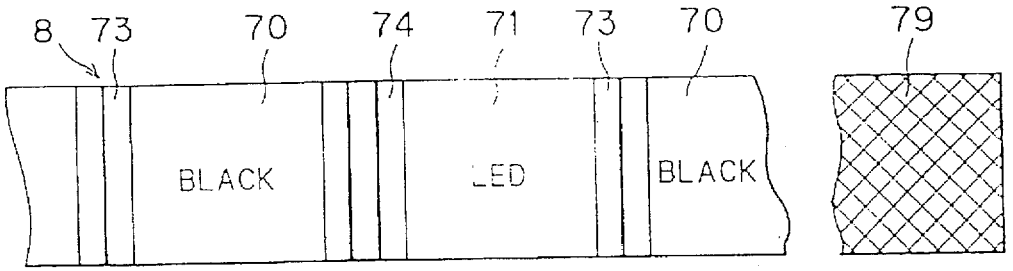
FIG. 23 is an explanatory view showing one example of an ink ribbon.

Next, operation of the tape printer will be described. FIGS. 18 and 19 show printing operations wherein the cassette 2 houses a receptor-type print tape 8. In the present embodiment, a distance L of 25 mm separates the print element 13 from the position where the print tape 8 is cut by the cutting mechanism 52. Further, as shown in FIG. 23, the ink ribbon 9 housed in the cassette 2 is colored in the lengthwise direction alternately with a black ink portion 70 and a red ink portion 71 with mark portions 73 and 74 therebetween. The pitch P of each color is 20 cm. the pitch being the sum of the ink portion and the mark portion.

Colors are distinguished by the light transmission type detection means 16 (FIG. 4). More specifically, the mark portion 73 is provided with a single black bar code before the black ink portion 70, and the mark portion 74 is provided with two black bar codes before the red ink portion 71. Each bar code is detectable by the detection means 16. The following description will be provided for printing two levels of character trains in the widthwise direction of the print tape 8 using the two-color ink ribbon 9 as described above.

When the cassette 2 is set in the receiving portion 3 of the printer body 1, the ink color, the width of the print tape 8, and the type of print tape 8 are distinguished by the combination of ON and OFF signals from the detection switches 300*a* through 300*f*, which are mounted to the body 1 in accordance with the Table 1. Next, color and the like are commanded (inputted) using the operation switches 6 on the printer body 1 and characters are inputted using the keyboard 5. When the print switch is depressed, the tape drive motor 24 rotates in the normal direction. At first, it is impossible to distinguish which color ink portion of the ink ribbon 9 is located (either red or black) at the print element 13. Therefore, the ink ribbon 9 and the print tape 8 are feed to a predetermined position. As shown in FIG. 18, in this case, the platen 25 of the platen holder 30 and the press roller 26 of the press roller holder 31 press against the print element 13 and the tape feed roller 19, respectively. The amount at which the ink ribbon 9 and the print tape 8 are feed is controlled by the amount at which the tape feed roller 19 and the press roller 26 are rotated. At first, the feed amount at which the ink ribbon 9 is fed is the sum of the distance L (25 mm in the present embodiment) added to the amount that must be fed until the mark portion 73 for the black ink portion 70 or the mark portion 74 for the red ink portion 71 is detected by the detection means 16.

For example, if the black ink portion 70 is first detected, printing is first performed with black ink. If the length of the image, such as a character train, is 15 cm, the print tape 8 and the ink ribbon 9 are integrally rapidly fed 5 cm even if printing is completed. The pitch by the sum of the ink portion and the mark portion is constant (20 cm) irrespective of the colors, and the amount in which the ink ribbon 9 is fed is controlled by the amount in which the print tape 8 is fed (20 cm). Therefore, by distinguishing the color by the mark portion 73 or 74 which first appears, there is no need to detect the position of the ink portion for a subsequent printing operation, thus facilitating control of tape feed.

Next, the platen operation motor 48 is driven so that the platen holder 30 is angularly moved to move the platen 25 away from the print element 13 (see FIG. 19) by the engagement between the cam 47 and the abutment portion 46*a* of the platen connection lever 46. As shown in FIG. 5, when the tape drive motor 24 is reversely rotated, the gear 84 of the gear train will rotate in the clockwise direction. Thus, the planet gear 92, which is supported on the swinging arm 91, disengages from the gear 93 of the ribbon drive cam 22. Therefore, take up of the ink ribbon 9 is stopped. On the other hand, the planetary gear 92 engages the idler gear 94 to causes the gear 95 to rotate in the counterclockwise direction. Further, the tape feed roller 19 is also rotated in the couterclockwise direction by the rotation of the gears 86 through 88. The press roller 26 is forced to rotate by the engagement of the gear 88 and the mesh gear 96. The print tape 8 nipped between the rollers 19 and 26 is thus reversely fed by 20 cm.

In the reverse feeding of the printed tape 8, the reverse rotation start timing of the platen 25, the tape feed roller 19 and the press roller 19 is delayed by the gears 87*a* and 87*b* as described above. Therefore, the print tape 8 will not be loosely rewound in the cassette 2.

Next, the platen operation motor 48 is driven so that the platen holder 30 is pivotally moved, thereby causing the platen 25 to press against the surface of the print element 13. Afterward, the tape drive motor 24 is rotated in the normal direction so that character train can be printed in red on the lower level. Incidentally, other printing layout is performed. For example, a single color ink ribbon 9 is used instead of the ribbon 9 shown in FIG. 23. After printing a character train on the print tape 8, the print tape 8 is rewound, and another character train is printed on the second level of the print tape 8 in the widthwise direction of the print tape 8, thus printing two line character trains with the identical color. Alternatively, an ornamental frame can be printed around the character train, or the character train can be printed over again to form bold print. Regardless, as described above, after the first character train is printed, the print tape 8 only is rewound a suitable distance while the ink ribbon 9 remains stationary. Printing can then again be executed.

Figure 24:
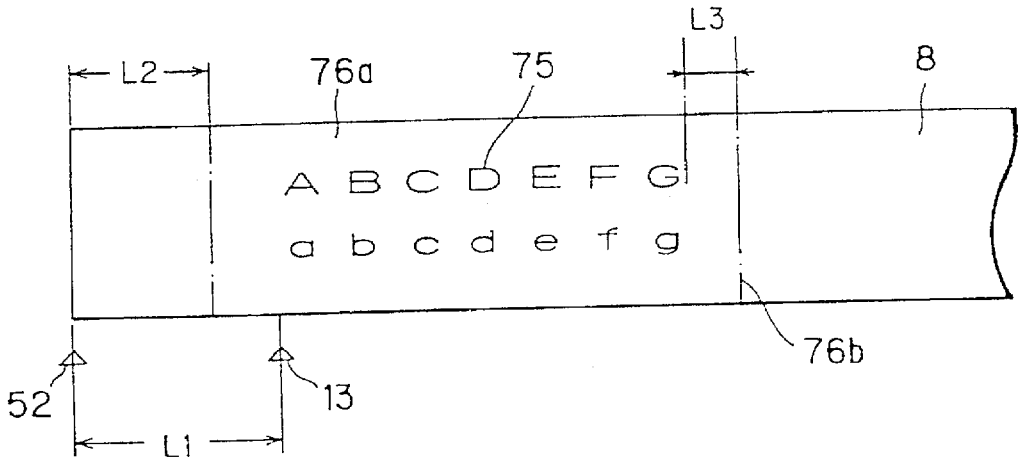
FIG. 24 is an explanatory view showing dual line characters printed on the print tape and leading end and trailing end margins of the tape.

Next, will be described with reference to FIG. 24, operation for reducing the margin by shortening the distance from the end portion (cut edge) in the lengthwise direction of the print tape 8 to the start of the character train. In the present embodiment, L1 is the distance from the print element 13 to the cutting mechanism 52. Conventionally the print tape 8 is transported only toward where the print tape 8 exits from the tape printer. Therefore, the position of the print tape 8 when printing starts comes after the position of the margin at distance L1, thereby producing a long margin.

In the present embodiment, before printing starts, the print tape 8 is rewound only the distance L2 (which is less that the distance L1) and rewinding stops. Next, the printing operations are executed while the print tape 8 is transported in the forward direction.

Further, a trailing end margin length can also be controlled. For example, after an image 75, such as a character train as described previously, is printed, the print tape 8 and the ink ribbon 9 are transported forward only the margin distance L3 in addition to the distance L1 from the terminal edge of the printed image region. Then the print tape 8 is cut at the cut portion 76*b*. More specifically, the character "G" or "g" is positioned at the printing element 13 when completing the printing. By forwardly moving the print tape by the length L1, the rear edge of the character "G" or "g" reaches the cutting mechanism 52. Then by further moving the print tape by the length L3, the cutting edge 76*b* reaches the cutting mechanism 52. When printing is next performed, printing is started after the print tape 8 is rewound a suitable distance L2. In this way, a long margin distance is not produced and printing can be performed without wasting print tape 8.

Figure 27:
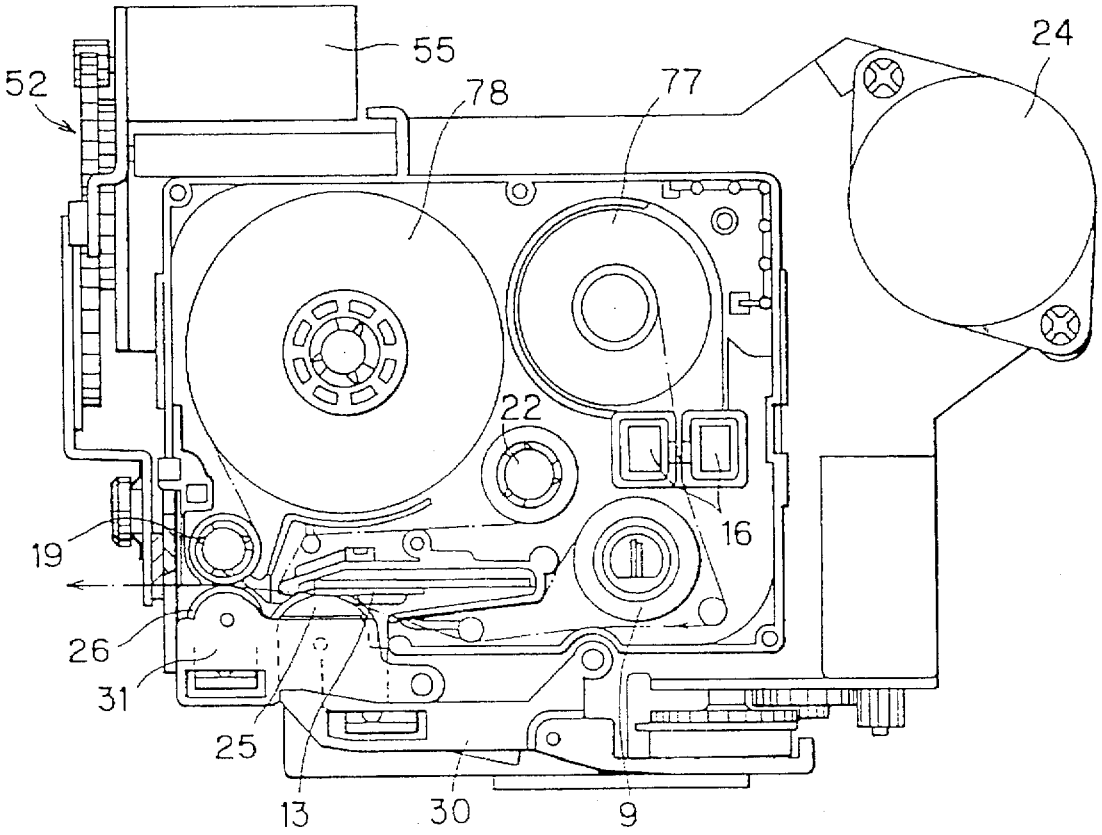
FIG. 27 is an explanatory plan view showing a state where a laminated type print tape housed in the cassette is installed in the tape printer.

FIG. 27 shows a second embodiment in which performed is printing to a laminate type print tape housed in the cassette 2. In case of the tape cassette 2 accommodating therein the laminate type print tape, a transparent tape 77, an ink ribbon 9, and a dual-sided adhesive tape 78 are housed in the cassette 2. The transparent tape 77 is adapted to pass through the detection means 16 instead of the ink ribbon 9 in contrast to the receptor type tape cassette.

The cassette 2 is mounted in the printer body 1 in the same manner as in the foregoing embodiment. The transparent tape 77 and the ink ribbon 9 are transported forward in the direction of the print element 13 while a mirror image of the image, such as characters, is printed on the transparent tape 77. Afterward, the transparent tape 77 and the dual-sided adhesive tape 78 are fed stacked one on the other between the tape feed roller 19 and the press roller 26 so that the printing surface of the transparent tape 77 adheres to one of the adhesive surfaces of the dual-sided adhesive tame 78. The other adhesive surface of the dual-sided adhesive tape 78 has a peelable tape (not shown), coated with a parting agent, such as silicon, temporarily attached thereto. The print tape is prohibited from being transported in the reverse direction for two color printing, or two line printing, since the adhesive tape 78 has already been adhered onto the printed surface of the transparent tape 77 in the first printing.

In the first embodiment, a non-transparent tape 79, such as aluminum tape, can be connected between the terminal end of the ink ribbon 9 and the spool 15 for detecting the terminal end of the ink ribbon 9. Upon detecting the non-transparent tape 79 by the detection means 16, subsequent printing operation of the tape can be stopped. Further, in the second embodiment, the non-transparent tape 79 can also be connected to the terminal end of the transparent tape 77 in case the transparent tape 77 used is laminated type. The non-transparent tape 79 can be detected by the detection means 16, since the transparent tape 77 passes the detection means 16.

Further, in the above described embodiments, the ink ribbon 9 is used for printing. However, the ink ribbon 9 can be dispensed with by employing a heat-sensitive-coloring print tape. In this case, the heat-sensitive-coloring tape may be non-transparent. For detecting the terminal end of the print tape, its terminal end is connected with a transparent zone, so that the detection means 16 can detect the terminal end of the non-transparent heat-sensitive-coloring print tape.

While the invention has been described in detail and with reference to specific embodiments thereof, it would be apparent to those skilled in the art that various changes and modifications may be made therein without departing from the spirit and scope of the invention.

What is claimed is:

1. A tape cassette for use in a tape printer, the tape printer including a tape transport mechanism for transporting a tape in a forward direction and a reverse direction, the tape transport mechanism having a drive source and a drive cam, a tape cassette receiving portion for receiving the tape cassette, the drive cam being positioned in the tape cassette receiving portion, and a print controller controlling printing operation to print an image on the tape, the drive cam including a central shaft portion and a plurality of protrusions radially outwardly projecting from the central shaft portion, the drive source including a reversible drive motor rotatable in a normal direction for providing the tape transport in the forward direction and in a reverse direction for providing the tape transport in the reverse direction, the drive cam being drivingly connected to the reversible drive motor only when the reversible drive motor is rotated in the reverse direction; the tape cassette comprising:

a tape cassette case having a tape outlet port;

a ribbon and a ribbon spool, said ribbon being mounted on said ribbon spool;

a tape spool rotatably supported on the tape cassette case for windingly holding the tape, the tape being discharged outside through the outlet port when the tape is transported in the forward direction for printing an image on the tape, the tape spool having an inner peripheral surface provided with an engaging member interlockingly engageable with the drive cam at least when the tape is fed in the reverse direction, said engaging member driving said tape spool in the reverse direction so said tape is taken up by said tape spool when said engaging member is rotated in the reverse direction by the drive cam.

2. The tape cassette as claimed in claim 1, wherein the engaging member comprises a plurality of projections radially inwardly projecting from the inner peripheral surface of the tape spool, the projections being engageable with the protrusions of the drive cam.

3. The tape cassette as claimed in claim 2, further comprising a tape feed roller rotatably supported in the cassette case, the tape feed roller being drivingly engageable with the tape transport mechanism when the tape cassette is received in the cassette receiving portion, whereby the tape is transported in both the forward and reverse direction by normal and reverse rotation of the tape feed roller.

4. The tape cassette as claimed in claim 3, further comprising:

said ribbon spool rotatably supported on the cassette case and windingly holding an ink ribbon; and a ribbon take up spool rotatably supported on the cassette case and taking up the ink ribbon, the ribbon take up spool being drivingly connectable to the reversible drive motor only when the reversible drive motor is rotated in the normal direction.

5. The tape cassette as claimed in claim 4, further comprising a detected portion which indicates at least one of size and variety of the tape.

6. The tape cassette as claimed in claim 5, wherein the detected portion comprises a plurality of presence and absence of parts of the cassette case, a combination of a plurality of presence and absence indicating the at least one of size and variety of the tape.

7. The tape cassette as claimed in claim 6, wherein the tape comprises a receptor type print tape on which a positive image is printed through the ink ribbon.

8. The tape cassette as claimed in claim 6, wherein the tape comprises a laminate type print tape on which a mirror image is printed through the ink ribbon.

9. The tape cassette as claimed in claim 6, further comprising a plurality of guide rollers rotatably supported on the cassette case and guiding travel of the tape within the cassette case.

10. The tape cassette as claimed in claim 1, further comprising:

a ribbon spool rotatably supported in the cassette case, an elongated ribbon being windingly held in the ribbon spool; and a ribbon take up spool rotatably supported in the cassette case for taking up the ribbon over the ribbon take up spool.

11. The tape cassette as claimed in claim 10, wherein the engaging member comprises a plurality of rib-like projections radially inwardly projecting from the inner peripheral surface of the tape spool, the projections being engageable with protrusions of a drive cam of a tape printer.

12. The tape cassette as claimed in claim 10, further comprising a tape feed roller rotatably supported in the cassette case at a position adjacent to the tape discharge outlet.

13. The tape cassette as claimed in claim 10, further comprising a plurality of guide rollers rotatably supported in the cassette case for guiding travel of the tape within the cassette case.

14. The tape cassette as claimed in claim 1, wherein the engaging member of the tape spool is engagable with the plurality of protrusions of the drive cam when the tape is fed in the reverse direction for reprinting over a printed image, printing another different color image or adjusting a print margin.

15. A tape printer for forming an image on a tape, the tape being wound over a tape spool, the printer comprising:

a tape transport mechanism transporting the tape in a forward direction for printing an image on the tape and a reverse direction rewinding the tape over the tape spool, the tape transport mechanism having a drive source drivingly rotatable in a normal and a reverse direction, a power transmission mechanism connected to the drive source, and a first drive cam drivingly engageable with the tape spool when the drive source is rotated in the reverse direction, said first drive cam transporting the tape in the reverse direction wherein the tape spool winding thereon the tape is rotatably supported in a tape cassette; and a print controller controlling printing operation to print the image on the tape.

16. A tape printer as claimed in claim 15, wherein the tape transport mechanism further comprises power transmission shut off mechanism provided between the power transmission mechanism and the first drive cam, the power transmission shut off mechanism shutting off the transmission of normal rotation of the drive source to the first drive cam but transmitting the reverse rotation of the drive source to the first drive cam.

17. The tape printer as claimed in claim 16, wherein the tape spool has an inner peripheral surface provided with a plurality of radially inwardly extending projections, and wherein the first drive cam comprises a central shaft portion and a plurality of protrusions radially outwardly projecting from the central shaft, the protrusions being engageable with projections of the tape spool for transmitting driving force of the first drive cam to the tape spool.

18. The tape printer as claimed in claim 17, wherein the tape cassette also rotatably supports therein a tape feed roller;

and wherein the tape printer further comprises a tape cassette receiving portion for receiving the tape cassette, the first drive cam being positioned in the tape cassette receiving portion, and wherein the tape transport mechanism further comprises a second drive cam drivingly connected to the drive source through the power transmission mechanism, the second drive cam being engageable with the tape feed roller for rotating the tape feed roller in a normal and reverse directions in accordance with the normal and reverse rotation of the drive source.

19. The tape printer as claimed in claim 18, wherein the drive source of the tape transport mechanism comprises a reversible drive motor, and the power transmission mechanism comprises a gear train whose one end is connected to the reversible drive motor and another end is connected to the second drive cam, the power transmission shut off mechanism being disposed at an intermediate portion of the gear train.

20. The tape printer as claimed in claim 19, wherein the gear train comprises a first drive cam gear coaxially coupled to the first drive cam, and wherein power transmission shut off mechanism comprises:

an idle gear meshedly engaged with the first drive cam gear;

a swing arm having a base end pivotally movable in one direction in accordance with a normal rotation of the reversible drive motor and movable in opposite direction in accordance with the reverse rotation of the reversible drive motor, the swing arm having a free end;

a planetary gear rotatably supported at the free end of the swing arm, the planetary gear being meshedly engageable with the idle gear when the swing arm is pivoted in the opposite direction for drivingly rotating the first drive cam gear but being out of engagement with the idle gear when the swing arm is pivoted in the one direction.

21. The tape printer as claimed in claim 15, wherein the first drive cam provides a plurality of protrusions, and the tape spool has an inner peripheral surface formed with an engaging member, the engaging member being engagable with the plurality of protrusions when the tape is fed in the reverse direction by the tape transport mechanism for reprinting over a printed image, printing another different color image or adjusting a print margin.

* * * * *